United States Patent [19]

Volk et al.

[11] Patent Number: 4,930,287

[45] Date of Patent: Jun. 5, 1990

[54] DISTORTION-FREE VINYL SIDING

[75] Inventors: Joseph Volk, North Tonawanda; Salvatore R. Taravella, Buffalo, both of N.Y.

[73] Assignee: National Gypsum Company, Dallas, Tex.

[21] Appl. No.: 868,245

[22] Filed: May 29, 1986

Related U.S. Application Data

[62] Division of Ser. No. 263,855, May 14, 1981.

[51] Int. Cl.[5] ..... B28B 11/12

[52] U.S. Cl. ..... 52/748; 264/145

[58] Field of Search ..... 264/145, 177 R; 52/519, 52/520, 521, 526, 527, 523, 524, 525, 748

[56] References Cited

U.S. PATENT DOCUMENTS

| | | | |
|---|---|---|---|
| 3,233,382 | 2/1966 | Graveley, Jr. | 52/527 |
| 3,504,467 | 4/1970 | Hatch et al. | 52/521 |
| 3,520,099 | 7/1970 | Mattes | 52/521 |
| 4,186,538 | 2/1980 | Marcum, Jr. | 52/530 |
| 4,327,528 | 5/1982 | Fritz | 52/533 |
| 4,435,933 | 3/1984 | Krowl | 52/520 |

*Primary Examiner*—Michael Safavi

*Attorney, Agent, or Firm*—Robert F. Hause; Laird F. Miller

[57] ABSTRACT

Elongate extruded sections of vinyl siding, having a top edge portion, which is intended to be hidden in use behind the bottom edge of an immediately higher section of siding, wherein the top edge portion is slit crosswise at a plurality of spaced apart locations, permitting freer expansion and contraction of the exposed portion of the siding with changes in temperature.

4 Claims, 2 Drawing Sheets

DISTORTION-FREE VINYL SIDING

CROSS REFERENCE TO RELATED APPLICATION

This application is a division of copending application, Ser. No. 06/263,855, filed May 14, 1981.

This invention relates to thin elongate siding, and particularly to extruded polyvinyl chloride siding, commonly referred to as vinyl siding, having an overlapped top, or side, portion, including a nailing attachment portion and an interlock receiver, which is formed with stress relief areas at spaced locations.

Extruded vinyl siding is a commonly used form of lap siding for residential construction. One problem that exists with present vinyl siding is the possibility of distortion occurring and becoming noticeable if and when the siding temperature becomes very high.

This distortion, sometimes referred to as "oil canning", results from the fact that the top hidden nailing and interlock portion of the siding expands and contracts, being heated and cooled with changes in temperature, at a different rate from the exposed, bottom portion. This apparently results from the fact that the bottom portion is exposed to the sun's rays and the top interlock and nailing section is not, plus the fact that this top portion commonly includes elements which are of a greater thickness of vinyl than the thickness of the exposed, bottom portion.

In accordance with the invention, a plurality of spaced apart short saw cuts are made in the siding, extending downward from the top edge to substantially the bottom of that portion of the siding which is concealed, in use.

It is an object of the invention to produce an improved elongate thin lap siding.

It is a further object to provide relatively distortion-free thin lap siding.

It is a still further object to provide a vinyl siding resistant to distortion when subjected to wide changes in temperature.

These and other objects and advantages of the invention will be more readily apparent when considered in relation to the preferred embodiments as set forth in the specification and shown in the drawings in which.

Figure 1:
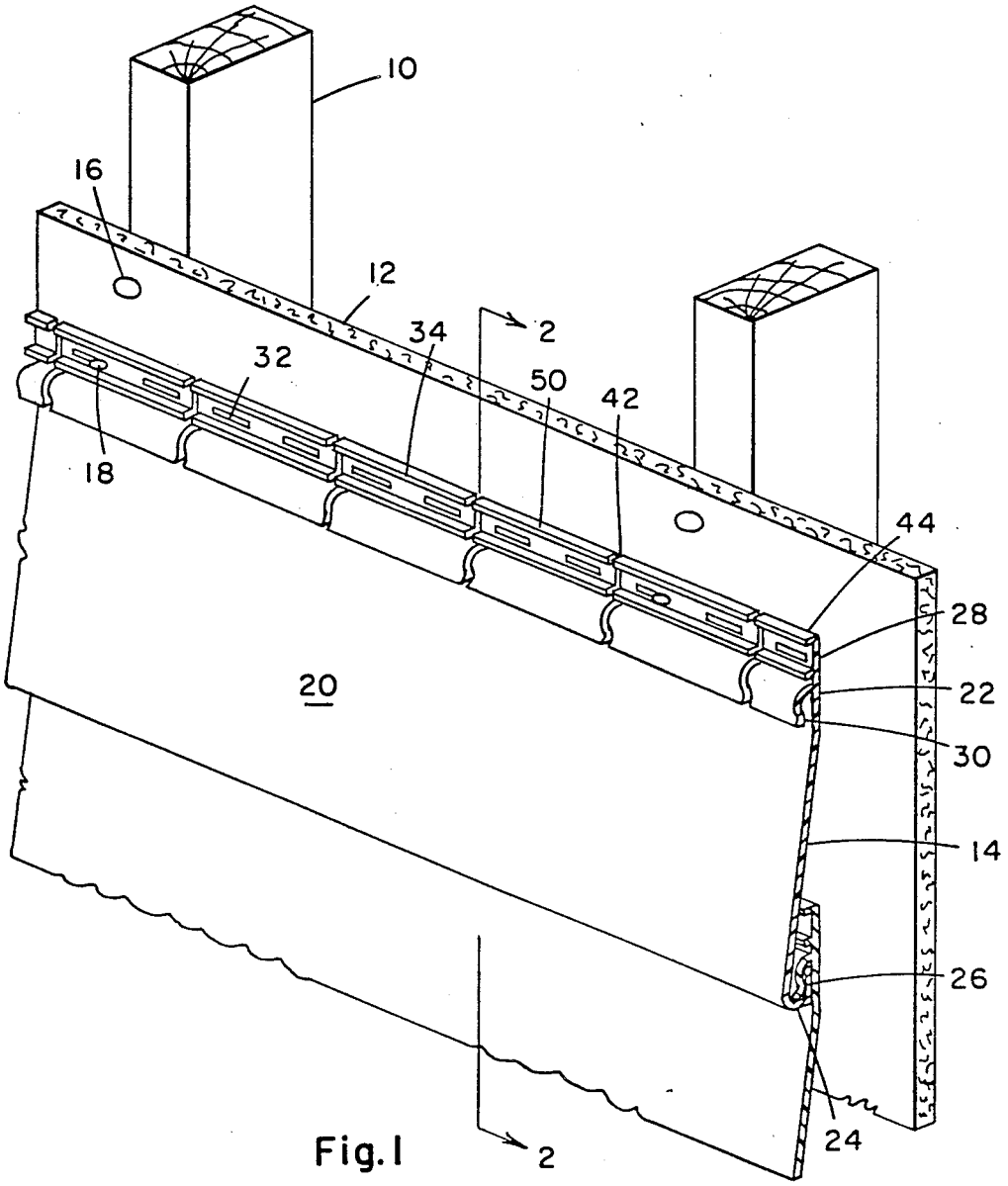
FIG. 1 is an isometric view of two sections of vinyl siding, made in accordance with the invention, applied to the side of a building.
Figure 3:
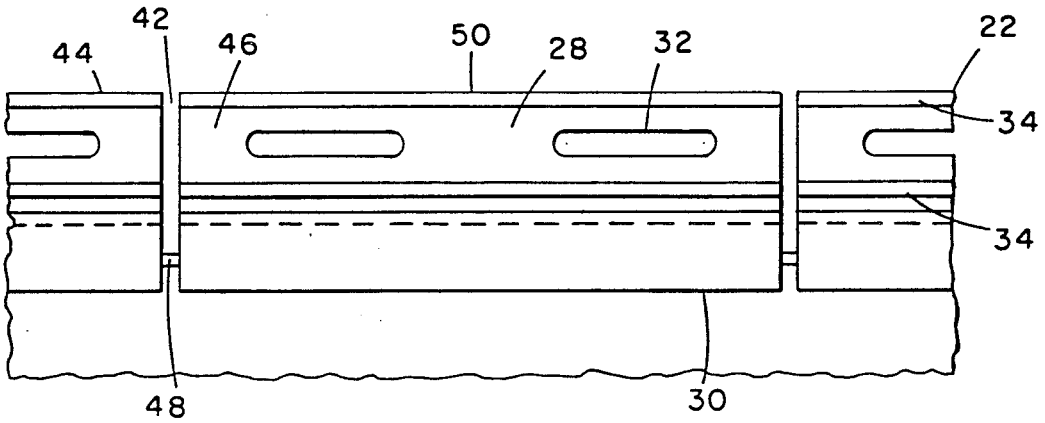
FIG. 3 is a front view of a part of the siding of FIG. 1.

Referring to FIG. 1, there is shown framing members 10, exterior sheathing 12 and two courses of extruded vinyl lap siding 14, which together form the exterior of a building. Sheathing 12 is attached to the framing members 10 with nails 16. Vinyl siding 14 is affixed to sheathing 12 by nails 18; however, other fastening means, such as staples and clips, may also be used. In the embodiment disclosed the sections of siding extend, horizontally; however, the sections could extend vertically, or even diagonally.

Vinyl siding 14 is produced by extruding elongate integral sections of about 10 to 20 feet in length, having a shape to simulate wood lap siding. The siding 14 includes a main face portion 20, a top concealed portion 22 and a bottom perpendicular spacer flange 24 and, at the outermost end thereof, an upwardly extending short interlock flange 26.

The top concealed portion 22 includes an upper attachment portion 28 and a lower interlock receiver channel 30, opening downwardly, for the reception of an interlock flange 26 of the siding section 14 located immediately thereabove. The attachment portion 28 includes a plurality of spaced apart, longitudinally aligned, elongated nailing slots 32. Slots 32 are disposed between two spaced, parallel guide ribs 34, provided to assist an applicator, while nailing, to prevent driving the nail in until it is tight. When applied, the siding should be free to move laterally, relative to the nails, when expansion and contraction of the attachment portion tend to cause some movement.

The interlock receiver channel 30 is formed of an "h" section, in which the long leg 36 connects the attachment portion 28 to the face 20, and a short horizontal leg 38 and an outer downward leg 40 coact with the long leg 36 to form the downwardly opening channel 30.

Typically, the face portion 20 is about eight to ten inches wide, the long leg 36 is about threefourths of an inch wide and the attachment portion 28 is about a half inch wide. The nailing slots are about 5/32" wide and one inch long, with a spacing of one inch between adjacent slots.

In accordance with a preferred form of the invention, narrow slits 42 are located at spacings of four inches, extending from the top edge 44 downward substantially to the bottom of the top concealed portion 22. The slits 42 extend downward through a solid area 46 of the attachment portion between slots 32, and, in the preferred form, through alternating solid areas 46.

Figure 2:
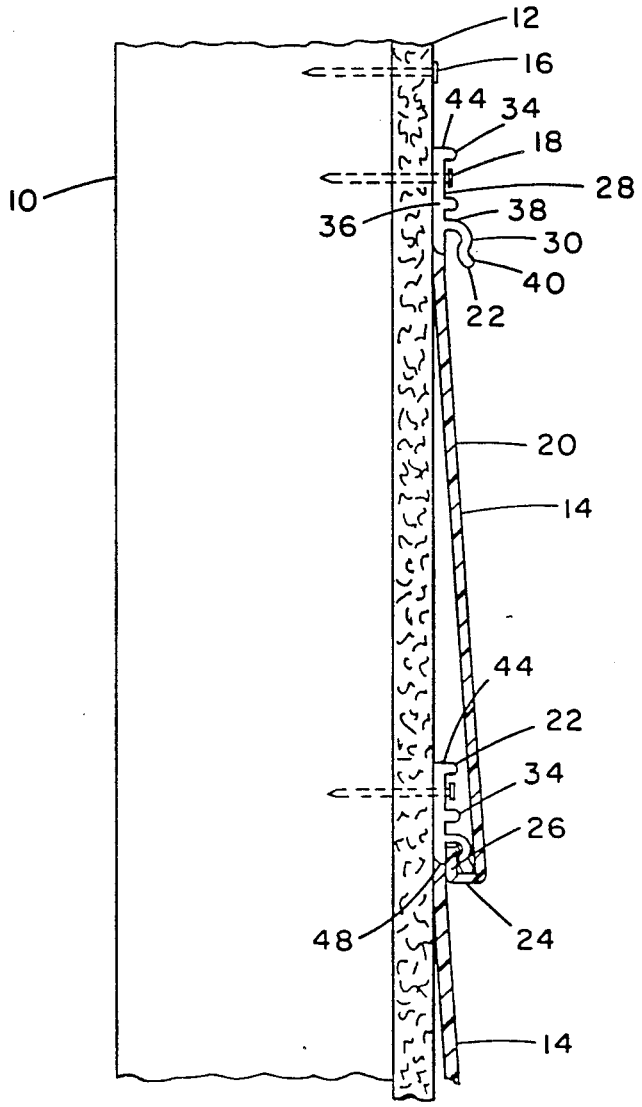
FIG. 2 is a vertical sectional view of the siding taken on line 2—2 of FIG. 1.

In the preferred form, the slit 42 is formed by cutting with a circular saw, with the cut being made by moving the circular saw into the top concealed portion 22 Just enough to completely sever the outer downward leg 40, and with the circular saw blade disposed at the completion of the cut such that the slit does not extend as far into the long leg 36 as into the outer downward leg, forming a diagonal slit bottom 48 in long leg 36, as best shown in FIG. 2. The slits 42 form longitudinally separated portions 50 of top concealed portion 22. The circular saw blade forms a slit of about ⅛ inch width; however, a much narrower slit or even a knife slit with no width is contemplated as within the invention.

The presence of the slits 42 has made it possible for the novel siding of the invention to be heated, while applied in overlapping relation, to temperatures which are as high as can be tolerated without softening and sagging of the vinyl, without the prior problem of oil canning, even in the most susceptible darker colors.

The slits can be placed apart anywhere from about every two inches to every foot with improvement therefrom in the lesser oil canning. The novel slits can also provide the improved performance with any other form of cross section configuration, including an upper concealed portion, such as the well known double four configuration, and with or without the presence of sheets of insulating backer board behind the face portion 20.

Having completed a detailed description of the preferred embodiments of our invention so that those skilled in the art may practice the same, we contemplate that variations may be made without departing from the essence of the invention.

We claim:

1. The method of making elongate, thin integral sections of lap siding comprising the steps of forming an elongate thin section of material formed to be applied in overlapping relation on a building exterior and including an exposed elongate face portion along one side and an elongate concealed portion along the opposite side formed to be overlapped by an adjacent section of lap siding, all portions of said concealed portion being originally formed in an unbroken, continuous elongate form and substantially all portions of said concealed portion subsequently being divided into a plurality of longitudinally separated portions by the removal of material, said removal of material being at spaced locations along the concealed portion edge and extending inwardly from said edge substantially to the innermost extent of said concealed portion thus severing substantially all portions of said concealed portion, said concealed portion including elongate means for receiving an interlocking elongate bottom edge of an overlapping section of lap siding and said removal of material extending through said elongate receiving means.

2. The method of claim 1 wherein said concealed portion includes longitudinally extending nailing slots aligned in spaced positions therealong, with solid areas between said nailing slots, and said removal of material extends through at least some of said solid areas.

3. The method of claim 1 wherein said forming of said elongate thin section of material is an extrusion of thermoplastic material.

4. The method of claim 1 wherein said removal of material comprises cutting saw cuts with a circular saw.

* * * * *